US010765913B2

(12) United States Patent
Michaud

(10) Patent No.: US 10,765,913 B2
(45) Date of Patent: Sep. 8, 2020

(54) FOOT AND ANKLE STRENGTHENING DEVICE

(71) Applicant: Newton Biomechanics, LLC, Wayland, MA (US)

(72) Inventor: Thomas C. Michaud, Wayland, MA (US)

(73) Assignee: Newton Biomechanics, LLC, Wayland, MA (US)

( * ) Notice: Subject to any disclaimer, the term of this patent is extended or adjusted under 35 U.S.C. 154(b) by 89 days.

(21) Appl. No.: 16/117,526

(22) Filed: Aug. 30, 2018

(65) Prior Publication Data

US 2019/0070459 A1 Mar. 7, 2019

Related U.S. Application Data

(60) Provisional application No. 62/553,525, filed on Sep. 1, 2017.

(51) Int. Cl.

| | |
|---|---|
| ***A63B 23/08*** | (2006.01) |
| ***A63B 23/10*** | (2006.01) |
| ***A63B 21/068*** | (2006.01) |
| ***A63B 21/00*** | (2006.01) |
| ***A63B 1/00*** | (2006.01) |

(52) U.S. Cl.

CPC ..... *A63B 23/08* (2013.01); *A63B 1/00* (2013.01); *A63B 21/00047* (2013.01); *A63B 21/068* (2013.01); *A63B 21/4033* (2015.10); *A63B 23/10* (2013.01); *A63B 2209/00* (2013.01)

(58) Field of Classification Search

CPC ..... A63B 23/08; A63B 1/00; A63B 21/00047; A63B 21/4033; A63B 21/068; A63B 23/10; A63B 2209/00

See application file for complete search history.

(56) References Cited

U.S. PATENT DOCUMENTS

| | | | | |
|---|---|---|---|---|
| 2,746,921 A * | 5/1956 | Menaul | C09K 8/78 507/253 |
| D339,638 S * | 9/1993 | Bucher | D24/212 |
| D348,108 S * | 6/1994 | Kim | D24/212 |
| 5,724,687 A * | 3/1998 | Kim | A47C 31/00 5/630 |

(Continued)

OTHER PUBLICATIONS

Abstract from Reber, L et al., Muscular control of the ankle in running. Am J Sports Med. 1993; 21:805-810, 1 page.

(Continued)

*Primary Examiner* — Sundhara M Ganesan

(74) *Attorney, Agent, or Firm* — RMCK Law Group, PLC

(57) ABSTRACT

A foot and ankle strengthening device can include a wedge block formed of a resilient material. The wedge block can comprise a base surface that defines a base plane, and a top surface substantially opposite the base surface and including a plurality of raised bulges. The top surface can extend from a front side to a back side along a longitudinal axis and from a left side to a right side along a horizontal axis, and have a midpoint ridge arranged between the left and right side. The top surface can be sloped downwardly from the front side to the back side at the midpoint ridge and along the longitudinal axis and from the midpoint ridge to the left side and right side along the horizontal axis. The base surface can be configured to contact a ground surface to support the wedge block.

20 Claims, 5 Drawing Sheets

(56) References Cited

U.S. PATENT DOCUMENTS

| | | | | |
|---|---|---|---|---|
| 7,101,344 | B1 * | 9/2006 | Wu | A61H 7/001 441/129 |
| 9,132,308 | B2 | 9/2015 | Kole et al. | |
| 9,387,359 | B2 | 7/2016 | Ferri | |
| D776,211 | S | 1/2017 | Gebhard et al. | |
| 10,441,496 | B1 * | 10/2019 | Cohen | A61H 15/00 |
| 2002/0091343 | A1 * | 7/2002 | Chen | A61H 7/001 601/136 |
| 2004/0210175 | A1 * | 10/2004 | Robbins, III | A61H 7/001 601/134 |
| 2012/0040810 | A1 * | 2/2012 | Astilla | A63B 21/00047 482/131 |

OTHER PUBLICATIONS

Alfredson, H. et al., Heavy-Load Eccentric Calf Muscle Training For the Treatment of Chronic Achilles Tendinosis, The American Journal of Sports Medicine, vol. 26, No. 3, 1998, pp. 360-366.

Allen, R.H. et al., "Toe Flexors Strength and Passive Extension Range of Motion of the First Metatarsophalangeal Joint in Individuals With Plantar Fasciitis," Journal of Orthopaedic & Sports Physical Therapy, vol. 33, No. 8, Aug. 2003, pp. 468-478.

Endo, M. et al., "Effects of Age and Gender on Toe Flexor Muscle Strength," Journal of Gerontology: Medical Sciences, vol. 57A, No. 6, 2002, pp. M392-M397.

Goldmann, J. et al., "The potential of toe flexor muscles to enhance performance," Journal of Sports Sciences, vol. 31, No. 4, 2013, pp. 424-433.

McKeon, P. et al., "Interventions for the Prevention of First Time and Recurrent Ankle Sprains," Clinical Sports Medicine, vol. 27, 2008, pp. 371-382.

Menz, H.B. et al., "Foot and Ankle Characteristics Associated With Impaired Balance and Functional Ability in Older People," Journal of Gerontology: Medical Sciences, vol. 60A, No. 12, 2005, pp. 1546-1552.

Noorkõiv, M. et al., "Neuromuscular Adaptations Associated With Knee Joint Angle-Specific Force Change," Med. Sci. Sports Exerc., vol. 46, No. 8, 2014, pp. 1525-1537.

Roos, E. et al., "Foot Orthoses for the Treatment of Plantar Fasciitis," Foot & Ankle International, vol. 27, No. 8, Aug. 2006, pp. 606-611.

Sullivan, J. et al., "Musculoskeletal and Activity-Related Factors Associated With Plantar Heel Pain," Foot & Ankle International, vol. 36(I), 2015, pp. 37-45.

World Health Organization, Global Report on Falls Prevention in Older Age, 2007, Geneva, Switzerland, 53 pages.

* cited by examiner

Section DD

Section EE

Section FF

FOOT AND ANKLE STRENGTHENING DEVICE

CROSS-REFERENCE TO RELATED APPLICATIONS

This application claims the benefit of U.S. Provisional Application No. 62/553,525, filed Sep. 1, 2017. The entire disclosure of the above application is incorporated herein by reference.

FIELD

The present disclosure generally relates to an exercise device designed to stretch and strengthen the muscles of the ankle and foot, more specifically, the toe muscles.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Weakness of the foot musculature, specifically, the muscles of the arches and toes, has been correlated with the development of a wide range of foot/ankle injuries. For example, plantar fasciitis, which eventually afflicts more than 10% of the population, is associated with long-term deficits in toe strength. Further, toe weakness has been correlated with falls in the elderly. Research proves that older adults have toe strength declines of more than 28% and the subsequent toe weakness has been correlated with an increased risk of fall. Falls in the elderly are extremely common and the probability of a person over 70 years of age experiencing a fall is almost 40%.

Despite the fact that toe and arch weakness poses significant health risks, few exercise devices exist that specifically target these important muscles. Furthermore, the majority of exercise devices that do exist use a complex assortment of springs, elastic bands and/or hinges, making them difficult to use and expensive. Ease-of-use is particularly important for the elderly population, who may be at high risk for falls due to age-related toe weakness.

SUMMARY

In various aspects of the present disclosure, a foot and ankle strengthening device is disclosed. The foot and ankle strengthening device can include a wedge block formed of a resilient material. The wedge block can comprise a base surface that defines a base plane, and a top surface substantially opposite the base surface and including a plurality of raised bulges. The top surface can extend from a front side to a back side along a longitudinal axis and from a left side to a right side along a horizontal axis. The top surface can also have a midpoint ridge arranged between the left and right side. The top surface can be sloped downwardly from the front side to the back side at the midpoint ridge and along the longitudinal axis at a first angle defined from the base plane. Further, the top surface can be sloped downwardly from the midpoint ridge to the left side and along the horizontal axis at a second angle defined from the base plane and from the midpoint ridge to the right side and along the horizontal axis at a third angle defined from the base plane.

The base surface can be configured to contact a ground surface to support the wedge block when a user places at least one foot on the top surface.

In other aspects of the present disclosure, a foot and ankle strengthening device can include a wedge block formed of a single piece of a resilient material. The wedge block can comprise a base surface that defines a base plane, and a top surface substantially opposite the base surface and including a plurality of raised bulges. The top surface can extend from a front side to a back side along a longitudinal axis and from a left side to a right side along a horizontal axis. The top surface can also have a midpoint ridge arranged between the left and right side. The top surface can be sloped downwardly from the front side to the back side at the midpoint ridge and along the longitudinal axis at a first angle defined from the base plane. In certain aspects, the first angle can be at least nine degrees. The top surface can also be sloped downwardly from the midpoint ridge to the left side and along the horizontal axis at a second angle defined from the base plane and from the midpoint ridge to the right side and along the horizontal axis at a third angle defined from the base plane. Each of the second and third angles can be at least nine degrees. Finally, the base surface can be configured to contact a ground surface to support the wedge block when a user places at least one foot on the top surface.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1D:
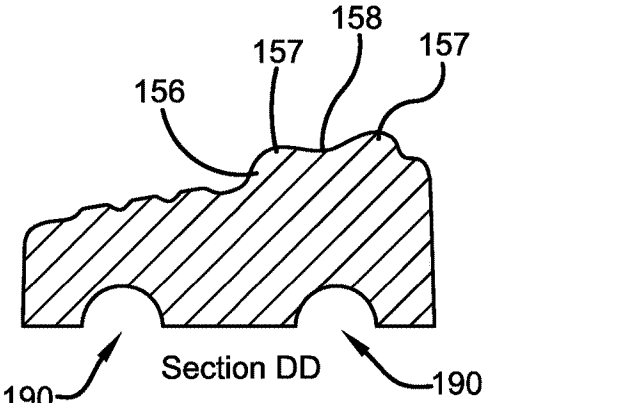
FIG. 1D is a sectional view side view of the foot and ankle strengthening device of FIG. 1A taken along line D-D.

The present disclosure is related to a foot and ankle strengthening device that addresses the above noted and other deficiencies with existing exercise devices. The disclosed exercise device is a simple foot strengthening device that precisely targets the peroneals, posterior calf muscles, and toe muscles. Correcting peroneal muscle strength weakness may be important because weakness in this muscle group has been correlated with recurrent inversion ankle sprains. Exercises to strengthen the peroneal muscles may be particularly important because, in the US alone, approximately 23,000 people sprain their ankle each day and the long-term costs of managing these injuries can exceed $1.1 billion annually. Peroneal muscle weakness may also be correlated with reduced running speeds, so strengthening the peroneal muscles is an important part of rehabilitation when managing running athletes.

With reference to FIGS. 1A-1F, an example foot and ankle strengthening device 10 is illustrated. The foot and ankle strengthening device 10 can comprise wedge block 100. The wedge block 100 can, e.g., be formed of a single piece of a resilient material, such as a single piece of low-density polyurethane foam. The wedge block 100 can comprise a base surface 110 and a top surface 120 that is substantially opposite the base surface 110. The base surface can define a base plane 112. For example only, the base plane 112 can be substantially coplanar with a ground surface (such as ground surface 400 shown in FIG. 4A) upon which the wedge block 100 is placed. The base surface 110 can be configured to contact a ground surface (e.g., ground surface 400) to support the wedge block when a user places at least one foot on the top surface 150.

The top surface 150 can extend from a front side 160 to a back side 162 along a longitudinal axis 164. Further, the top surface 150 can extend from a left side 165 to a right side 167 along a horizontal axis 169. In some aspects, the top surface 150 can also include a midpoint ridge 170 arranged between the left side 165 and the right side 167. It should be appreciated that, although the midpoint ridge 170 is illustrated as being located at the midpoint of the wedge block 100 and is called the "midpoint" ridge, the midpoint ridge 170 need not be located at the exact midpoint of the wedge block 100. For example only, in contrast to the substantially symmetrical wedge block 100 that is illustrated in the figures, the scope of the present disclosure is intended to include non-symmetrical wedge blocks 100 where the midpoint ridge 170 is located away from the actual midpoint.

Figure 2:
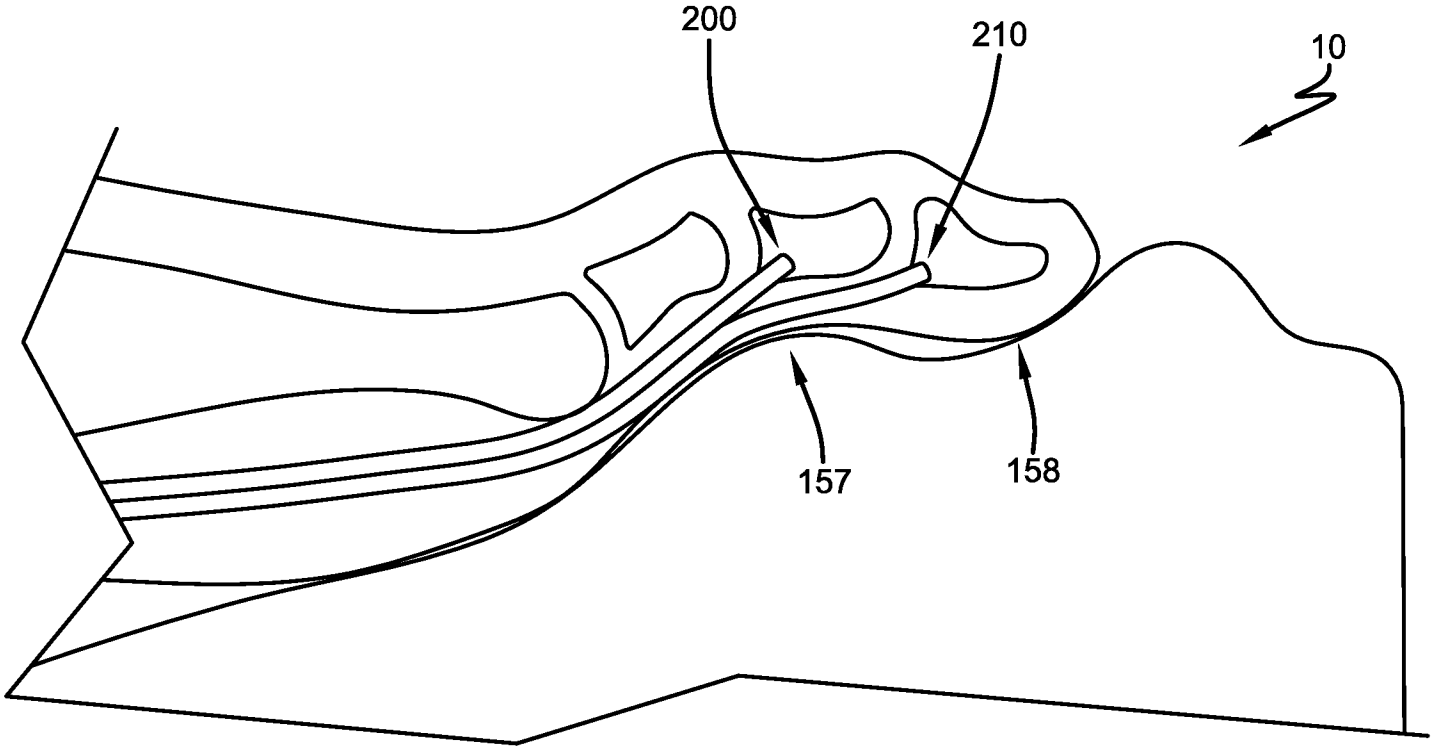
FIG. 2 is a partial sectional view of the foot and ankle strengthening device of FIG. 1 and a foot arranged thereupon.

The top surface 150 can include a plurality of raised bulges 152 that are utilized by a user to perform various exercises, as more fully described below. These raised bulges 152, independently from or in conjunction with the downward slope of the top surface 150 discussed below, can allow a user to exercise the muscles in his/her foot in the lengthened condition, which has been proven to produce more rapid strength gains than conventional exercises. According to some implementations, the plurality of raised bulges 152 can include a back ridge 154 arranged towards the back side 162 and a front ridge 156 arranged towards the front side 160. The front ridge 156 can comprise a crescent-shaped elevation shaped to include two crests 157 at high point of the front ridge 156 with a plateau 158 arranged therebetween (FIG. 1D). The front ridge 156 projects upward and can be shaped in such a way that allows a user to place his/her metatarsal heads at the base of the curved slope, with the center of the toes abutting the initial elevation, with the tips of the toes resting in the plateau 158. This particular shape provides both the long and short digital flexor muscles (Flexor Digitorum Brevis muscle 200 and Flexor Digitorum Longus muscle 210, FIG. 2) resistance as they plantarflex the intermediate and distal interphalangeal joints respectively (FIG. 2), which may specifically target the Flexor Digitorum Brevis muscle 200 of the user.

Figure 1E:
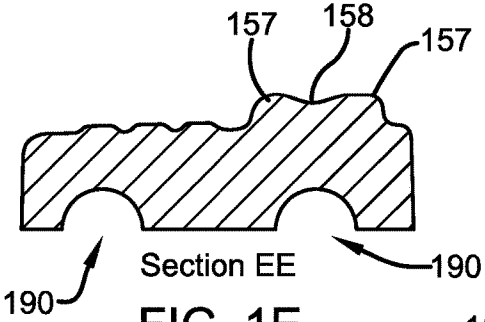
FIG. 1E is a sectional view side view of the foot and ankle strengthening device of FIG. 1A taken along line E-E.
Figure 1F:
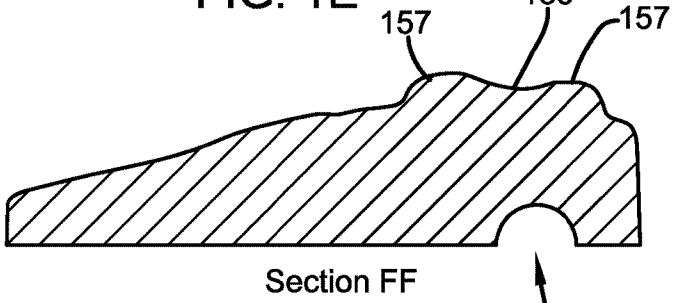
FIG. 1F is a sectional view side view of the foot and ankle strengthening device of FIG. 1A taken along line F-F.
Figure 1A:
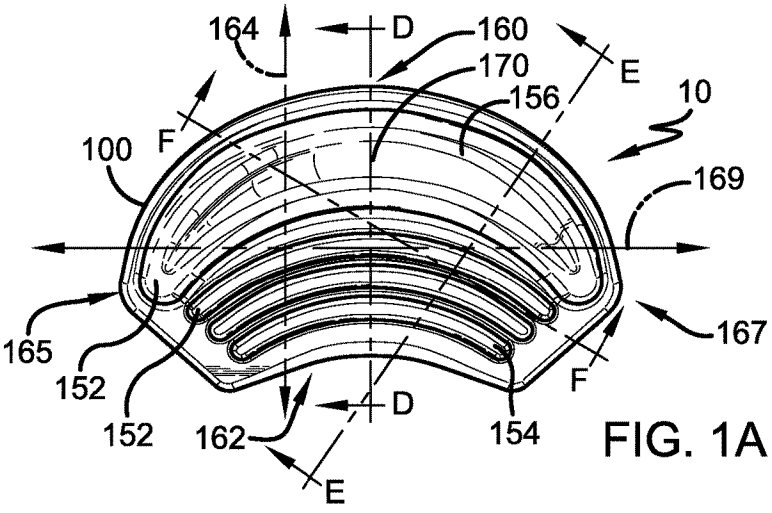
FIG. 1A is a top view of a foot and ankle strengthening device according to some aspects of the present disclosure.

The plateau 158 can be arranged below the two crests 157 to be at a point below the high point of the front ridge 156. In some aspects, the difference in height between the crests 157 and the plateau 158 may vary along the length of the front ridge 156, as shown in FIGS. 1D-1F. For example only, the difference in height between the crests 157 and the plateau 158 may be approximately 4.5 millimeters at the midpoint ridge 170 and be approximately 3.25 millimeters towards the left or right sides 165, 167 (e.g., such as along the line E-E and as shown in FIG. 1E). As briefly mentioned, the plurality of raised bulges 152 can be utilized by a user to perform various exercises, as more fully described below.

Figure 1B:
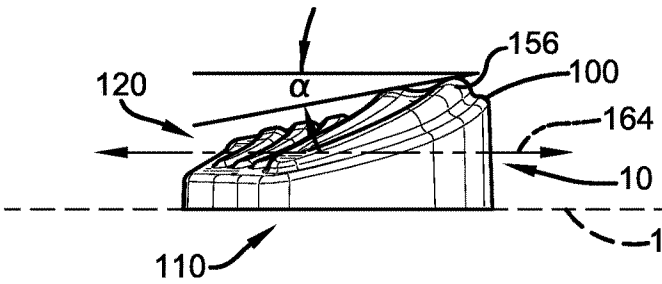
FIG. 1B is a side view of a foot and ankle strengthening device of FIG. 1A.

The wedge block 100 can be tilted in the frontal and sagittal planes in order to recruit/target often overlooked muscle groups. Accordingly, the top surface 150 can be sloped downwardly from the front side 160 to the back side 162 at the midpoint ridge 170 and along the longitudinal axis 164 at a first angle $\alpha$ defined from the base plane 112 in order to provide tilt in the sagittal plane (FIG. 1B). This downward slope may, during use, increase stress on the posterior calf muscles, particularly gastrocnemius, soleus, and tibialis posterior muscles, and such sagittal plane exercising of the calf muscles has been proven to be an effective way of managing chronic Achilles tendinopathy. In some implementations, the first angle $\alpha$ can be between seven and fifteen degrees. In other implementations, the first angle $\alpha$ can be at least nine degrees.

Figure 1C:
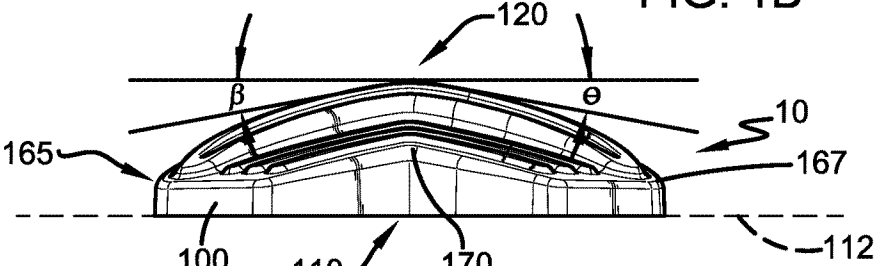
FIG. 1C is a rear view of a foot and ankle strengthening device of FIG. 1A.
Figure 3:
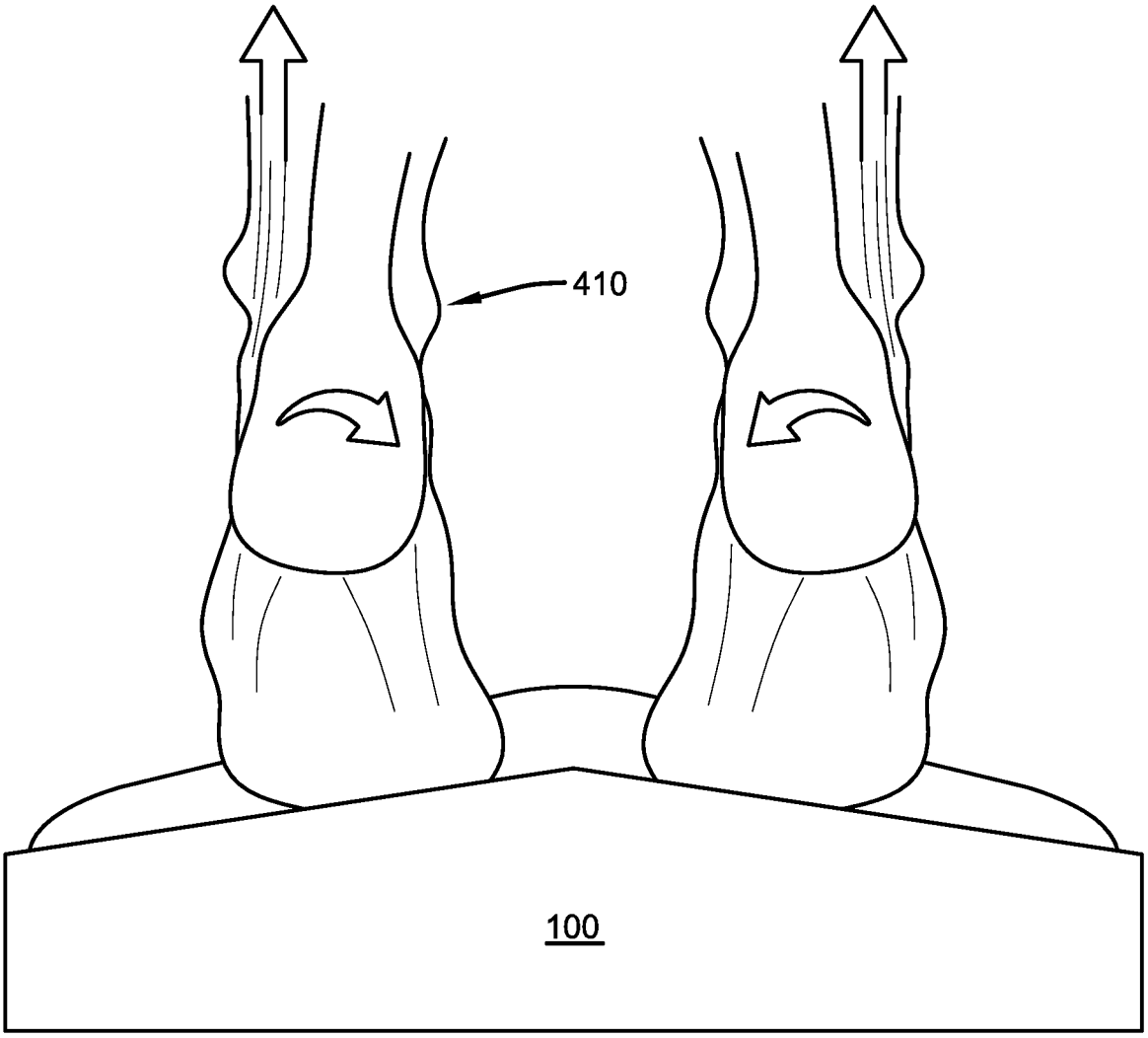
FIG. 3 is an illustration of a person that is standing on his/her toes on the foot and ankle strengthening device of FIG. 1.

Additionally or alternatively, the top surface can be sloped downwardly from the midpoint ridge 170 to the left side 165 and along the horizontal axis 164 at a second angle $\beta$ defined from the base plane 112 and from the midpoint ridge 170 to the right side 167 and along the horizontal axis 164 at a third angle $\theta$ defined from the base plane 112 in order to provide tilt in the frontal plane (FIG. 1C). This downward slope may increase activity in the peroneal muscles, which actively raise the heels from an inverted position (FIG. 3). As shown in FIG. 3, for example, the peroneal muscles may fire more vigorously (white arrows) as they are forced to evert the rearfoot (black arrows). In some implementations, the second and third angles $\beta$, $\theta$ can each be between seven and fifteen degrees. In other implementations, the second and third angles $\beta$, $\theta$ can each be at least nine degrees. The second and third angles $\beta$, $\theta$ can be equal to or different from each other, depending on the desires/requirements of the user.

In some aspects, and with particular reference to FIGS. 1D-1F, the back surface 110 can define one or more cutout portions 190. Each cutout portion 190 can be arranged at a location to modify a compression strength of the wedge block 100 at that location, e.g., opposite a location of the front ridge 156 or the back ridge 154. For example only, the back surface can define a front cutout portion 190 arranged opposite a location of the front ridge 156 and a back cutout portion 190 arranged opposite the back ridge 154. Other implementations are within the scope of the present disclosure. The cutout portions 190 may also reduce the pressure beneath the toes of user while performing exercises utilizing the foot and ankle strengthening device 10, as described more fully below.

As mentioned above, the foot and ankle strengthening device 10 of the present disclosure can be formed from a compressible foam that applies greater resistance to the toes of a user as the user leans forward, i.e., the farther a user leans forward, the greater the toe force generated (FIGS. 4A-4D). In such implementations, because the foam in the middle of the device 10 may be thickest, the big toe can be exposed to greater force as the user leans forward. This may be important because strength deficits in the user (e.g., an elderly user) may be more prevalent in the big toe than in the little toes. Through the use of the one or more cutout portions 190, the foot and ankle strengthening device 10 of the present disclosure can be customized to provide different compression strengths at different locations.

One application for the foot and ankle strengthening device 10 of the present disclosure is to prevent falls in the elderly. Because the majority of older adults fall while reaching or leaning forward, maintaining adequate toe strength may play a significant role in fall prevention. Several studies have shown that the ability to push down firmly with your toes while standing greatly improves balance by enhancing a person's functional base of support (FBOS). The forward limit of the FBOS in a healthy person may be considered to be proportional to the maximum total flexor muscle strength. The disclosed foot and ankle strengthening device 10 specifically strengthens the muscles responsible for maintaining the forward limit of the functional base of support.

Figure 4A:
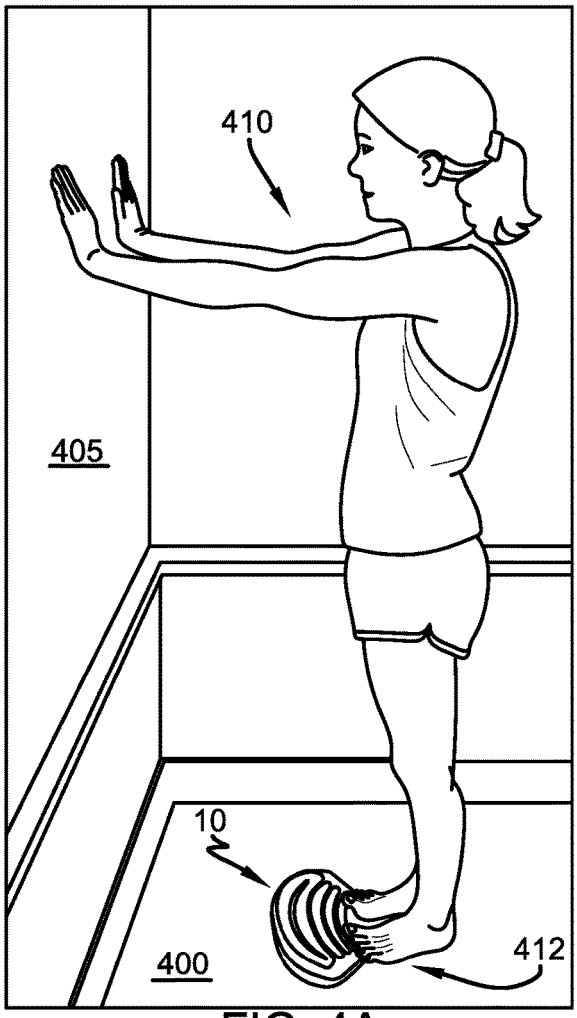
FIGS. 4A-D is an illustration of a person in different positions while utilizing the foot and ankle strengthening device of FIG. 1.
Figure 4B:
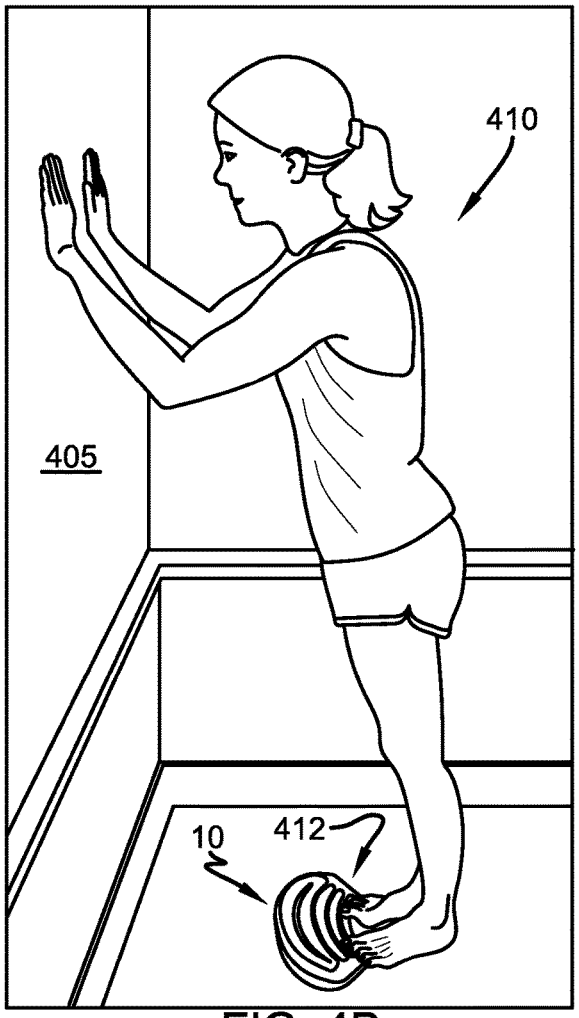
Figure 4C:
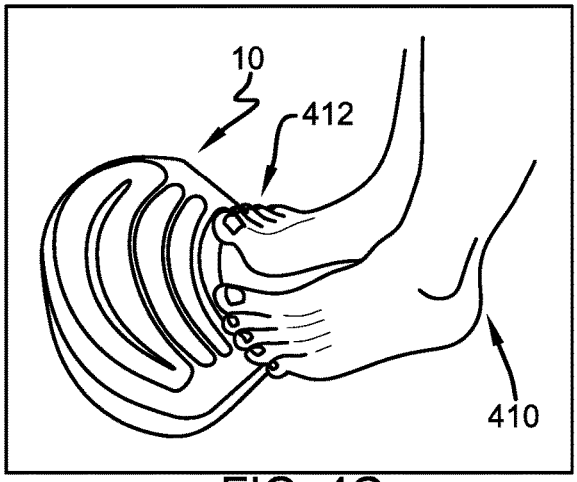
Figure 4D:
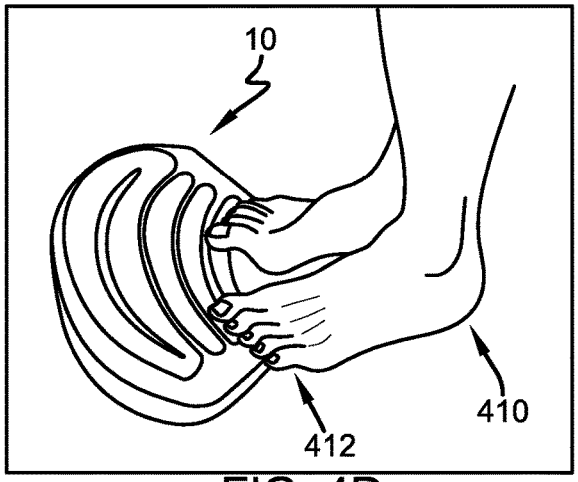

An example use of the foot and ankle strengthening device 10 of the present disclosure is illustrated in FIGS. 4A-4D. As shown in FIG. 4A, a user 410 stands with his/her feet flat on the ground 400 and the toes 412 supported by the back side 162 edges of the wedge block 100. The user 410 can then place his or her hands a distance (e.g., one inch) from a stable surface 405, such as a fixed table or a wall, and keeps the entire body straight as he/she tilts forward, pressing the toes 412 firmly into the foot and ankle strengthening device 10 (FIG. 4B). A slight forward lean with full toe activities can be maintained for a certain period (such as, five seconds) and then the user 410 can return to the original position. The user 410 may attempt to keep their hands a certain, safe distance (one inch) from the stable surface 405 at all times. The forward lean and extended toe press can be repeated a certain number of times (15, 20, 30, etc.). It is contemplated that the exercise discussed above is one example of how to properly utilize the disclosed foot and ankle strengthening device 10, and that other exercises and/or methods of use can be utilized.

Figure 5B:
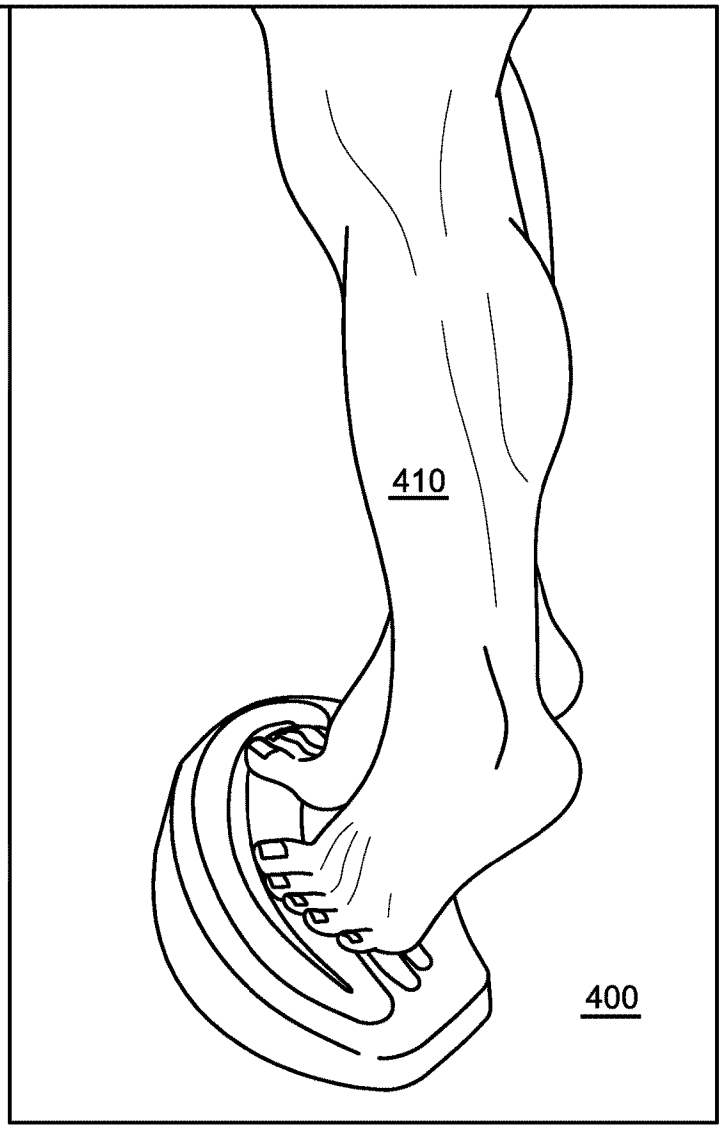
FIGS. 5A-B is another illustration of a person in different positions while utilizing the foot and ankle strengthening device of FIG. 1.
Figure 5A:
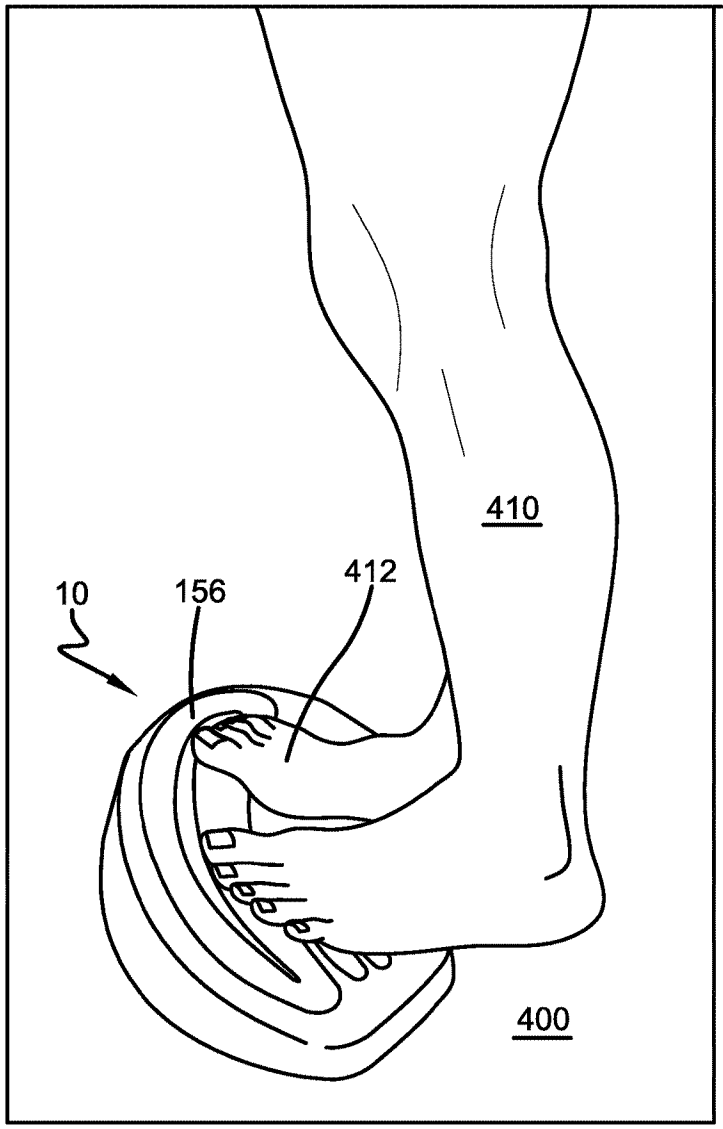

With reference to FIGS. 5A and 5B, to increase resistance and enhance strength in other muscles, the user 410 can place the toes 412 into the plateau 158 of the front ridge 156 (FIG. 5A). With the feet inverted, the user 410 raises the heels, driving their toes down 412 into the front ridge 156 (FIG. 5B). The user 410 then lowers the heels until they contact the ground 400 and then lifts the toes up off 412 the front ridge 156. This process can be repeated a certain number of times (15, 20, 30, etc.). Dropping the heels to the ground after each repetition effectively stretches the posterior calf muscles, which may be important because tight calves are a proven predictor of falls of the elderly. Once again, it is contemplated that the exercise discussed above is one example of how to properly utilize the disclosed foot and ankle strengthening device, and that other exercises and/or methods of use can be utilized.

Alternate methods of strengthening foot and ankle muscles include standing sideward on the top surface 10 of the foot and ankle strengthening device 10 with only the lateral or medial side of the foot contacting the top surface 150. By performing heel raises in this position, the foot is either inverted or everted, increasing activity in the peroneus longus and tibialis posterior muscles respectively. Notably, because the disclosed foot and ankle strengthening device 10 can be a single piece of material with no moving parts, the device can be safe and easy to use, especially for senior citizens who may lack the dexterity to set up even simple strengthening devices with bands and hinges.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known procedures, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The term "and/or" includes any and all combinations of one or more of the associated listed items. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A foot and ankle strengthening device, comprising:

a wedge block formed of a resilient material, the wedge block comprising:

a base surface that defines a base plane; and a top surface substantially opposite the base surface and including a plurality of raised bulges, the top surface extending from a front side to a back side along a longitudinal axis and from a left side to a right side along a horizontal axis, the top surface having a midpoint ridge arranged between the left and right side, wherein the top surface is sloped downwardly from the front side to the back side at the midpoint ridge and along the longitudinal axis at a first angle defined from the base plane, wherein the top surface is sloped downwardly from the midpoint ridge to the left side and along the horizontal axis at a second angle defined from the base plane and from the midpoint ridge to the right side and along the horizontal axis at a third angle defined from the base plane, and wherein the base surface is configured to contact a ground surface to support the wedge block when a user places at least one foot on the top surface.

2. The foot and ankle strengthening device of claim 1, wherein the first angle is at least nine degrees.

3. The foot and ankle strengthening device of claim 2, wherein the second angle is at least nine degrees.

4. The foot and ankle strengthening device of claim 3, wherein the second and third angles are equal.

5. The foot and ankle strengthening device of claim 1, wherein the plurality of raised bulges comprises a back ridge arranged towards the back side and a front ridge arranged towards the front side.

6. The foot and ankle strengthening device of claim 5, wherein the front ridge includes two crests and a plateau arranged between the two crests, wherein the plateau is arranged below the two crests.

7. The foot and ankle strengthening device of claim 5, wherein the back surface defines a cutout portion arranged substantially opposite a location of the front ridge or the back ridge.

8. The foot and ankle strengthening device of claim 5, wherein the back surface defines a front cutout portion arranged opposite a location of the front ridge and a back cutout portion arranged opposite a location of the back ridge.

9. The foot and ankle strengthening device of claim 1, wherein the wedge block is formed of a single piece of the resilient material.

10. The foot and ankle strengthening device of claim 1, wherein the resilient material comprises a polyurethane foam.

11. A foot and ankle strengthening device, comprising:

a wedge block formed of a single piece of a resilient material, the wedge block comprising:

a base surface that defines a base plane; and a top surface substantially opposite the base surface and including a plurality of raised bulges, the top surface extending from a front side to a back side along a longitudinal axis and from a left side to a right side along a horizontal axis, the top surface having a midpoint ridge arranged between the left and right side, wherein the top surface is sloped downwardly from the front side to the back side at the midpoint ridge and along the longitudinal axis at a first angle defined from the base plane, the first angle being at least nine degrees, wherein the top surface is sloped downwardly from the midpoint ridge to the left side and along the horizontal axis at a second angle defined from the base plane and from the midpoint ridge to the right side and along the horizontal axis at a third angle defined from the base plane, each of the second and third angles being at least nine degrees, and wherein the base surface is configured to contact a ground surface to support the wedge block when a user places at least one foot on the top surface.

12. The foot and ankle strengthening device of claim 11, wherein the second and third angles are equal.

13. The foot and ankle strengthening device of claim 11, wherein the plurality of raised bulges comprises a back ridge arranged towards the back side and a front ridge arranged towards the front side.

14. The foot and ankle strengthening device of claim 13, wherein the front ridge includes two crests and a plateau arranged between the two crests, wherein the plateau is arranged below the two crests.

15. The foot and ankle strengthening device of claim 13, wherein the back surface defines a cutout portion arranged substantially opposite a location of the front ridge or the back ridge.

16. The foot and ankle strengthening device of claim 15, wherein the cutout portion modifies a compression strength of the wedge block at its location.

17. The foot and ankle strengthening device of claim 13, wherein the back surface defines a front cutout portion arranged opposite a location of the front ridge and a back cutout portion arranged opposite a location of the back ridge.

18. The foot and ankle strengthening device of claim 11, wherein the resilient material comprises a polyurethane foam.

19. The foot and ankle strengthening device of claim 11, wherein the first angle is between seven and fifteen degrees.

20. The foot and ankle strengthening device of claim 19, wherein the second and third angles are equal and are between seven and fifteen degrees.

* * * * *